US007905585B2

(12) United States Patent
Tanaka et al.

(10) Patent No.: US 7,905,585 B2
(45) Date of Patent: Mar. 15, 2011

(54) LIQUID EJECTION APPARATUS

(75) Inventors: Ryoichi Tanaka, Shiojiri (JP); Toshio Kumagai, Shiojiri (JP)

(73) Assignee: Seiko Corporation, Tokyo (JP)

( * ) Notice: Subject to any disclaimer, the term of this patent is extended or adjusted under 35 U.S.C. 154(b) by 777 days.

(21) Appl. No.: 11/944,164

(22) Filed: Nov. 21, 2007

(65) Prior Publication Data

US 2008/0117268 A1 May 22, 2008

(30) Foreign Application Priority Data

Nov. 22, 2006 (JP) ..... 2006-315319

(51) Int. Cl.
*B41J 2/175* (2006.01)

(52) U.S. Cl. ..... 347/85

(58) Field of Classification Search ..... 347/84, 347/85

See application file for complete search history.

(56) References Cited

U.S. PATENT DOCUMENTS

| | | | | |
|---|---|---|---|---|
| 6,206,511 | B1 * | 3/2001 | Cook et al. | 347/85 |
| 6,786,578 | B1 * | 9/2004 | Aschman et al. | 347/85 |
| 7,281,785 | B2 * | 10/2007 | Palifka et al. | 347/85 |
| 7,699,451 | B2 * | 4/2010 | Nishida | 347/85 |

FOREIGN PATENT DOCUMENTS

| | | | |
|---|---|---|---|
| JP | 2001-187458 | A | 7/2001 |
| JP | 2003-344643 | A | 12/2003 |
| JP | 2006-175626 | A | 7/2006 |

* cited by examiner

*Primary Examiner* — Anh T. N. Vo
(74) *Attorney, Agent, or Firm* — Sughrue Mion, PLLC

(57) ABSTRACT

A liquid ejection apparatus includes a liquid ejection head that ejects a liquid and a switching device. The switching device includes a first ON-OFF valve that selectively opens and closes a first supply passage at a position upstream from the joining point, and a second ON-OFF valve that selectively opens and closes a second supply passage at a position upstream from the joining point. When the first ON-OFF valve is open and the second ON-OFF valve is closed, the liquid guide portion divides the first liquid into a first liquid flow proceeding from the first supply passage directly to the head supply passage and a second liquid flow flowing from the first supply passage into the head supply passage after passing the vicinity of the second ON-OFF valve in the second supply passage. When the first ON-OFF valve is closed and the second ON-OFF valve is open, the liquid guide portion divides the second liquid into a third liquid flow proceeding from the second supply passage directly to the head supply passage and a fourth liquid flow flowing from the second supply passage into the head supply passage after passing the vicinity of the first ON-OFF valve in the first supply passage.

9 Claims, 7 Drawing Sheets

LIQUID EJECTION APPARATUS

CROSS-REFERENCE TO RELATED APPLICATION

This application is based upon and claims the benefit of priority from prior Japanese Patent Application No. 2006-315319 filed on Nov. 22, 2006, the entire contents of which are incorporated herein by reference.

BACKGROUND

1. Technical Field

The present invention relates to a liquid ejection apparatus such as an inkjet type printer.

2. Related Art

Typically, an inkjet type printer (hereinafter, referred to as a printer) is broadly known as a liquid ejection apparatus that ejects liquid onto a target. In the printer, ink (the liquid) is supplied from an ink cartridge retaining the ink to a recording head (a liquid ejection head), which ejects the ink. The recording head ejects the ink through a nozzle defined in a nozzle forming surface of the recording head onto a sheet of recording paper, or the target, thus subjecting the sheet of paper to printing. If the ink cartridge is arranged at a position spaced from the recording head, as in some printers, the ink is supplied from the ink cartridge to the recording head through a tube routed in the printer.

To change the ink to be ejected from the nozzle of the recording head to a different type of ink, supply of the ink from the currently used ink cartridge to the recording head is suspended. In this state, the ink is drained from the tube through the nozzle of the recording head. The different type of ink is then supplied from a corresponding ink cartridge, which retains this type of ink, to the recording head through the tube.

However, such drainage of the ink in switching of the types of the ink wastefully increases consumption of the ink. To solve this problem, Japanese Laid-Open Patent Publication No. 2006-175626 proposes a printer having a switching device that is connected to tubes extending from respective ink cartridges and arranged in the vicinity of a recording head.

In the printer of Japanese Laid-Open Patent Publication No. 2006-175626, the types of ink supplied to the recording head is switched between a first type of ink (first liquid) and a second type of ink (second liquid) in the switching device. Specifically, in the switching device, the downstream end of a first passage (a first supply passage) that supplies the first type of ink and the downstream end of a second passage (a second supply passage) that supplies the second type of ink are joined together. A head supply passage through which the ink is supplied to the recording head is provided between the joining point and the recording head. The switching device accommodates a first diaphragm (a first ON-OFF valve), which selectively opens and closes the first passage, and a second diaphragm (a second ON-OFF valve), which selectively opens and closes the second passage. Supply of the ink is thus switched between the first type of ink and the second type of ink by closing one of the diaphragms and opening the other.

To supply the first type of ink to the recording head, the switching device opens the first diaphragm and closes the second diaphragm. Contrastingly, to supply the second type of ink to the recording head, the switching device opens the second diaphragm and closes the first diaphragm.

When the first diaphragm is open and the second diaphragm is closed in the above-described printer, the portion of the second passage between the joining point of the first and second passages and the second diaphragm forms a "dead end" portion. Similarly, when the second diaphragm is open and the first diaphragm is closed in the printer, the portion of the second passage between the joining point of the first and second passages and the first diaphragm forms a "dead end" portion.

Thus, when the first type of ink is supplied to the recording head, some of the ink is led from the first passage into the dead end portion of the second passage via the joining point and retained in the dead end portion. When the second type of ink is supplied to the recording head, some of the ink is sent from the second passage into the dead end portion of the first passage via the joining point and retained in the dead end portion.

The properties of the ink retained in the dead end portions deteriorate as the time elapses and the ink with the deteriorated properties gradually diffuses from the dead end portion and flows into the head supply passage. This adversely influences the properties of the ink to be ejected from the nozzle of the recording head.

SUMMARY

Accordingly, it is an objective of the present invention to provide a liquid ejection apparatus that prevents ink from being retained in a switching device that switches types of liquid to be supplied to a liquid ejection head.

To achieve the above object and in accordance with a first aspect of the present invention, a liquid ejection apparatus including a liquid ejection head that ejects a liquid and a switching device is provided. The switching device selectively switches types of the liquid supplied to the liquid ejection head between a first liquid and a second liquid different from the first liquid. The switching device includes a first supply passage through which the first liquid flows, a second supply passage through which the second liquid flows, a head supply passage, a first ON-OFF valve, a second ON-OFF valve, and a liquid guide portion. The head supply passage extends from a joining point between a downstream end of the first supply passage and a downstream end of the second supply passage to the liquid ejection head. The first ON-OFF valve selectively opens and closes the first supply passage at a position upstream from the joining point. The second ON-OFF valve selectively opens and closes the second supply passage at a position upstream from the joining point. The a liquid guide portion is formed in the first and second supply passages at a position between the first ON-OFF valve and the second ON-OFF valve. When the first ON-OFF valve is open and the second ON-OFF valve is closed, the liquid guide portion divides the first liquid into a first liquid flow proceeding from the first supply passage directly to the head supply passage and a second liquid flow flowing from the first supply passage into the head supply passage after passing the vicinity of the second ON-OFF valve in the second supply passage. When the first ON-OFF valve is closed and the second ON-OFF valve is open, the liquid guide portion divides the second liquid into a third liquid flow proceeding from the second supply passage directly to the head supply passage and a fourth liquid flow flowing from the second supply passage into the head supply passage after passing the vicinity of the first ON-OFF valve in the first supply passage.

In accordance with a second aspect of the present invention, a liquid ejection apparatus including a liquid ejection head that ejects a liquid and a switching device is provided. The switching device selectively switches types of the liquid supplied to the liquid ejection head between a first liquid and a second liquid different from the first liquid. The switching device includes a first supply passage through which the first liquid flows, a second supply passage through which the second liquid flows, a head supply passage, a first ON-OFF valve, a second ON-OFF valve, and a liquid guide portion. The first supply passage and the second supply passage extend along a common imaginary line and are joined together at the downstream ends of the first and second supply passages. The head supply passage extends from the joining point between the first supply passage and the second supply passage to the liquid ejection head. The first ON-OFF valve selectively opens and closes the first supply passage at a position upstream from the joining point. The second ON-OFF valve selectively opens and closes the second supply passage at a position upstream from the joining point. The liquid guide portion projects from a wall surface defining the first and second supply passages and extends linearly and continuously along both of the first and second supply passages.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

A first embodiment of the present invention will now be described with reference to the drawings. The "front-and-rear direction", the "left-and-right direction", and the "up-and-down direction" herein correspond to the directions indicated by the corresponding arrows in the attached drawings.

Figure 1:
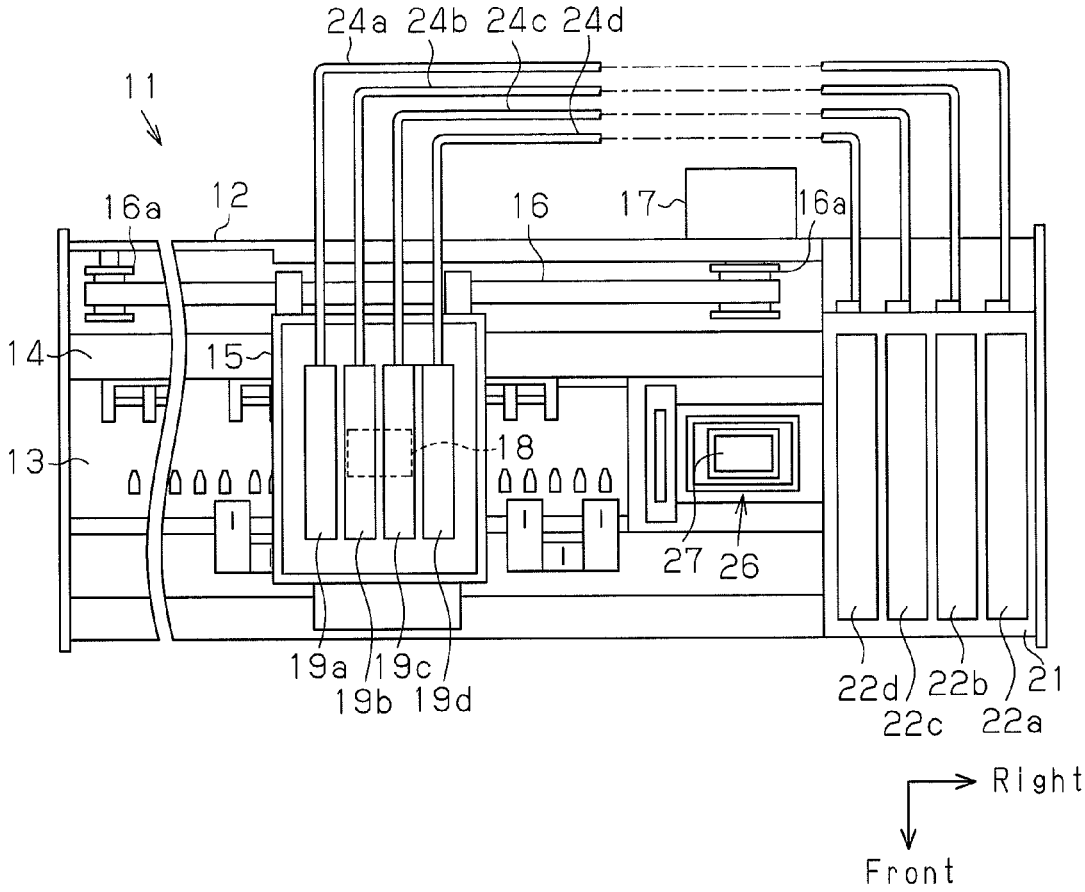
FIG. 1 is a plan view schematically showing an inkjet type printer according to an embodiment of the present invention.

As shown in FIG. 1, an inkjet type printer 11, or a liquid ejection apparatus, includes a body frame 12 having a rectangular form as viewed from above. A platen 13, which extends in the left-and-right direction coinciding with the main scanning direction, is provided in the body frame 12. A non-illustrated paper feeder mechanism sends a sheet of recording paper, or a target, along the platen 13 and in the front-and-rear direction coinciding with the sub scanning direction. A bar-like guide shaft 14, which extends parallel with the longitudinal direction of the platen 13 at a position above the platen 13, is arranged in the body frame 12.

The guide shaft 14 supports a carriage 15 in such a manner as to allow the carriage 15 to reciprocate in the axial direction of the guide shaft 14. The carriage 15 is connected to a carriage motor 17 mounted in a rear wall of the body frame 12 through an endless timing belt 16, which is wound around a pair of pulleys 16*a* provided in an inner surface of the rear wall. The carriage 15 is driven by the carriage motor 17 to reciprocate along the axial direction of the guide shaft 14.

Figure 2:
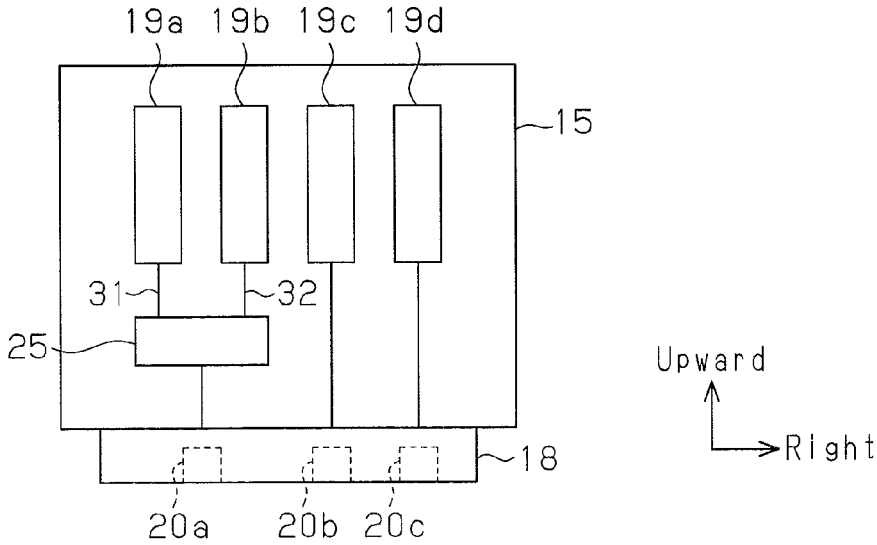
FIG. 2 is a front view schematically showing a carriage of the printer shown in FIG. 1.

With reference to FIGS. 1 and 2, a recording head 18, or a liquid ejection head, is mounted on the surface of the carriage 15 opposed to the platen 13. The carriage 15 accommodates valve units 19*a*, 19*b*, 19*c*, 19*d*, which temporarily retain ink as liquid and supply the ink to the recording head 18. In the first embodiment, four valve units, which are first valve unit 19*a*, a second valve unit 19*b*, a third valve unit 19*c*, and a fourth valve unit 19*d*, are provided. A plurality of (in the first embodiment, three) nozzles 20*a*, 20*b*, 20*c* are defined in the lower surface of the recording head 18. Droplets of the ink are thus ejected from the nozzles 20*a* to 20*c* onto the recording paper sheet (not shown), which has been fed onto the platen 13, thus subjecting the recording paper sheet to printing.

A cartridge holder 21 is arranged at the right end in the body frame 12. Ink cartridges 22*a*, 22*b*, 22*c*, 22*d*, which retain different types of ink, are removably mounted in the cartridge holder 21. In the first embodiment, four ink cartridges, which are a first ink cartridge 22*a*, a second ink cartridge 22*b*, a third ink cartridge 22*c*, and a fourth ink cartridge 22*d*, are provided. Each of the ink cartridges 22*a* to 22*d* is connected to the corresponding one of the valve units 19*a* to 19*d* mounted in the carriage 15 through a corresponding one of ink supply tubes 24*a*, 24*b*, 24*c*, 24*d*. When the ink cartridges 22*a* to 22*d* are installed in the cartridge holder 21, the ink cartridges 22*a* to 22*d* are connected to the corresponding valve units 19*a* to 19*d* through the associated ink supply tubes 24*a* to 24*d*.

The first ink cartridge 22*a* receives photo black ink, or first liquid, and the second ink cartridge 22*b* receives matte black ink, or second liquid. Thus, the first valve unit 19*a* temporarily retains the photo black ink and the second valve unit 19*b* temporarily retains the matte black ink.

The photo black ink is suitable for printing on glossy paper and the matte black ink is suitable for printing on matte paper. As shown in FIG. 2, a switching device 25 is arranged between the valve units 19*a*, 19*b* of the carriage 15 and the recording head 18. The switching device 25 switches the ink supplied from the valve units 19*a*, 19*b* to the recording head 18 between the photo black ink and the matte black ink.

The switching device 25 switches the ink ejected from the nozzle row 20*a* of the recording head 18 between the photo black ink and the matte black ink depending on whether glossy paper or matte paper is used.

With reference to FIG. 1, a home position of the carriage 15 is defined at a position close to the right end in the body frame 12. A maintenance unit 26, which performs cleaning on the recording head 18, is provided at the home position. The maintenance unit 26 includes a cap 27, which air-tightly seals the nozzles 20*a* to 20*c* of the recording head 18 and receives the ink that has been ejected from the nozzles 20*a* to 20*c* through flushing.

The switching device 25 will hereafter be explained in detail.

Figure 3:
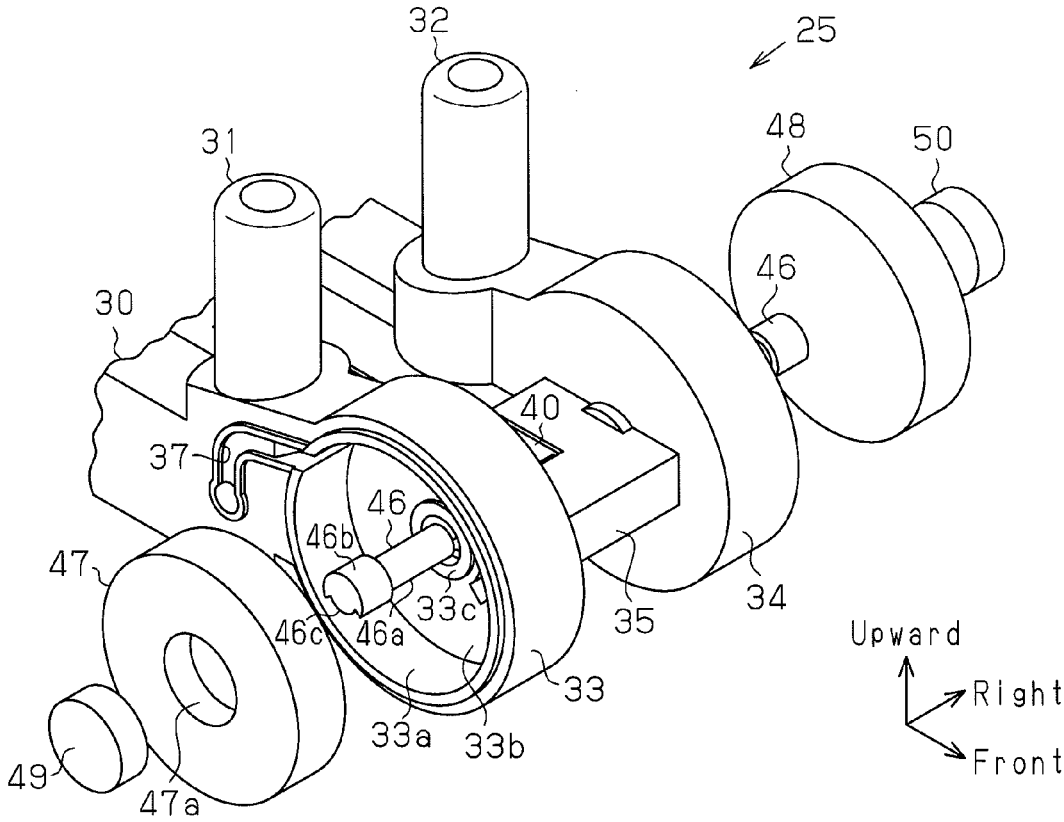
FIG. 3 is an exploded perspective view showing a switching device of the printer shown in FIG. 1.
Figure 4:
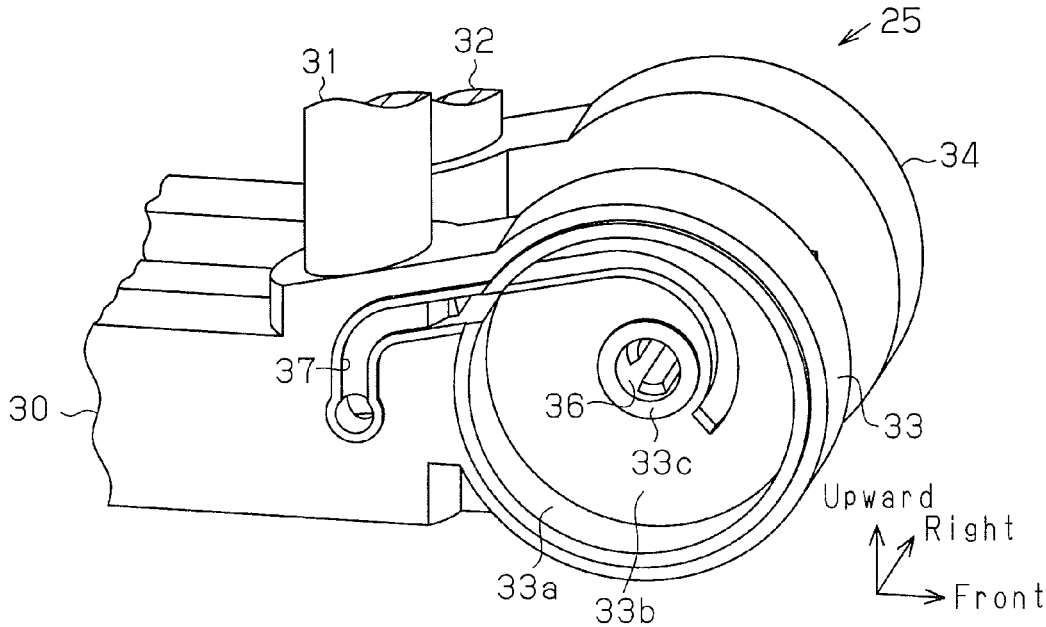
FIG. 4 is a perspective view showing a main portion of the switching device shown in FIG. 3.
Figure 5:
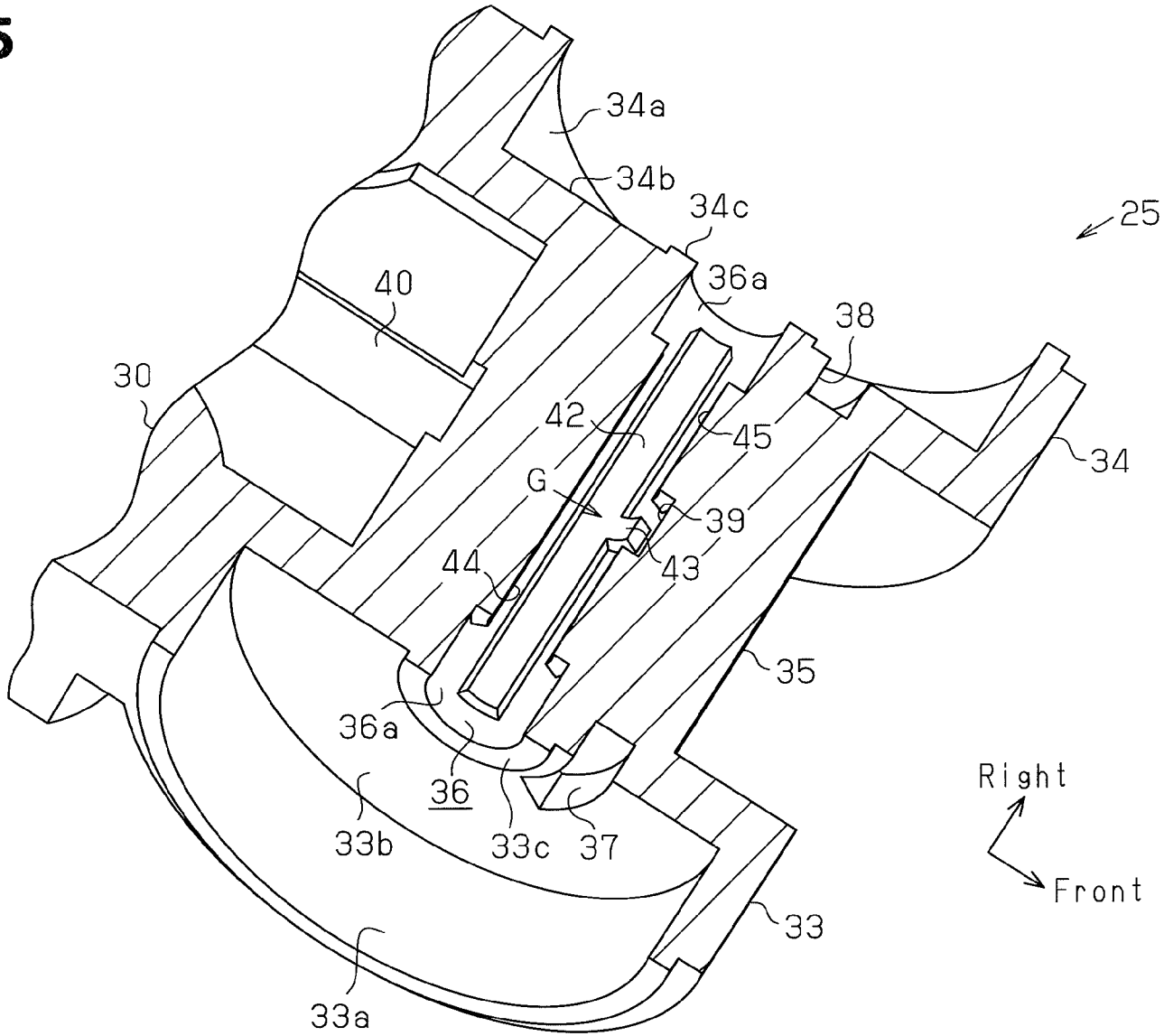
FIG. 5 is an enlarged cross-sectional view showing a main portion of a joint portion of the switching device shown in FIG. 3.

As shown in FIGS. 3 to 5, the switching device 25 includes a body 30 having a symmetric block-like shape and a pair of connection pipes, or a first connection pipe 31 and a second connection pipe 32. The first and second connection pipes 31, 32 are provided on the upper surface of the body 30 and spaced from each other at a predetermined interval. The first connection pipe 31 is connected to the first valve unit 19*a* and the second connection pipe 32 is connected to the second valve unit 19*b*. The switching device 25 has a first valve body receiving portion 33 having a cylindrical shape and a bottom with an opening faced leftward and a second valve body receiving portion 34 having a cylindrical shape and a bottom with an opening faced rightward. The first valve body receiving portion 33 is arranged forward from the first connection pipe 31 and the second valve body receiving portion 34 is provided forward from the second connection pipe 32.

A joint portion 35 is formed between the first valve body receiving portion 33 and the second valve body receiving portion 34. A joint passage 36, which extends linearly along the left-and-right direction, is defined in the joint portion 35. The first and second valve body receiving portions 33, 34 communicate with each other at their centers through the joint passage 36. In other words, the joint passage 36 has openings at the centers of the first and second valve body receiving portions 33, 34.

A first communication groove 37, through which the first connection pipe 31 communicates with the interior of the first valve body receiving portion 33, is defined in the body 30. The first communication groove 37 has a proximal end connected to the first connection pipe 31. The first communication groove 37 extends from its proximal end sequentially on the left surface of the body 30, an inner circumferential surface 33*a* of the first valve body receiving portion 33, and an inner bottom surface 33*b* of the first valve body receiving portion 33, in this order. The first communication groove 37 extends around the opening of the joint passage 36 on the inner bottom surface 33*b* from above and reaches a position diagonally downward and forward from the opening of the joint passage 36. An annular first projection 33*c* projects from the inner bottom surface 33*b* of the first valve body receiving portion 33 and encompasses the opening of the joint passage 36.

Like the first communication groove 37, a second communication groove 38, through which the second connection pipe 32 communicates with the interior of the second valve body receiving portion 34, is defined in the body 30. The second communication groove 38 has a proximal end connected to the second connection pipe 32. The second communication groove 38 extends from its proximal end sequentially on the right surface of the body 30, an inner circumferential surface 34*a* of the second valve body receiving portion 34, and an inner bottom surface 34*b* of the second valve body receiving portion 34, in this order. The second communication groove 38 extends around the opening of the joint passage 36 on the inner bottom surface 34*b* from above and reaches a position diagonally downward and forward from the opening of the joint passage 36. An annular second projection 34*c* projects from the inner bottom surface 34*b* of the second valve body receiving portion 34 and encompasses the opening of the joint passage 36.

Figure 6:
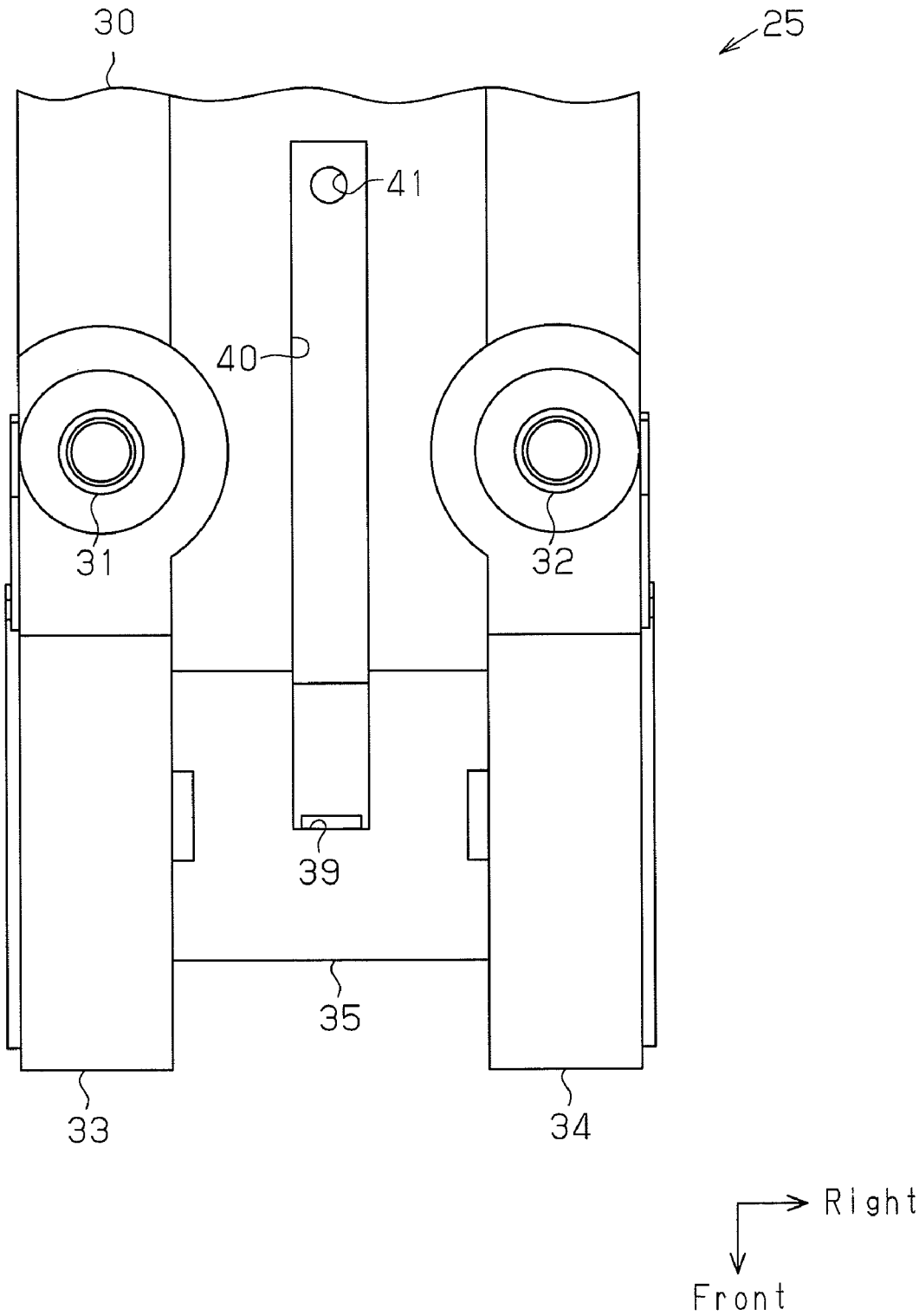
FIG. 6 is a plan view showing the switching device shown in FIG. 3.

As illustrated in FIG. 6, a groove 40 extending in the front-and-rear direction is defined in the upper surface of the joint portion 35. With reference to FIGS. 5 and 6, a first through hole 39 connecting the joint passage 36 to the front end of the groove 40, is defined at a forward position at the center of the joint passage 36 in the left-and-right direction. A second through hole 41 communicating with the recording head 18 (see FIG. 2) is defined at the rear end of the groove 40. A non-illustrated seal member, which seals the opening of the groove 40, is arranged on the upper surface of the joint portion 35. In the first embodiment, the first through hole 39, the groove 40, and the second through hole 41 form a head supply passage.

As illustrated in FIG. 5, a first joint line 44 is defined by the portion of the joint passage 36 extending leftward from the center in the left-and-right direction. A second joint line 45 is defined by the portion of the joint passage 36 extending rightward from the center. The center of the joint passage 36 forms a joining point G between the first joint line 44 and the second joint line 45. The first joint line 44, the second joint line 45, and the first through hole 39 communicate with one another at the joining point G.

Large diameter portions 36*a*, the diameters of which are greater than the diameter of the central portion of the joint passage 36, are provided at both ends of the joint passage 36, which are the left end of the first joint line 44 and the right end of the second joint line 45. A block-like ink guide portion (a liquid guide portion) 42 projects from the lower wall of the joint passage 36 and linearly extends along the joint passage 36 continuously from the first joint line 44 to the second joint line 45. The width of the ink guide portion 42, or the dimension of the ink guide portion 42 in a direction perpendicular to the longitudinal direction of the ink guide portion 42, becomes smaller toward the top of the ink guide portion 42. Both ends of the ink guide portion 42 reach the interiors of the corresponding large diameter portions 36*a* of the joint passage 36.

An interference suppressing portion 43 is provided in the ink guide portion 42 at the position corresponding to the first through hole 39. The interference suppressing portion 43 extends from a front surface of a central portion of the ink guide portion 42 toward the first through hole 39. The left portion and the right portion of the ink guide portion 42 are symmetrical with respect to the interference suppressing portion 43. In other words, the portions of the ink guide portion 42 divided by a plane extending perpendicular to the longitudinal direction of the ink guide portion 42 and including the interference suppressing portion 43 form mirror images in shape.

Figure 7:
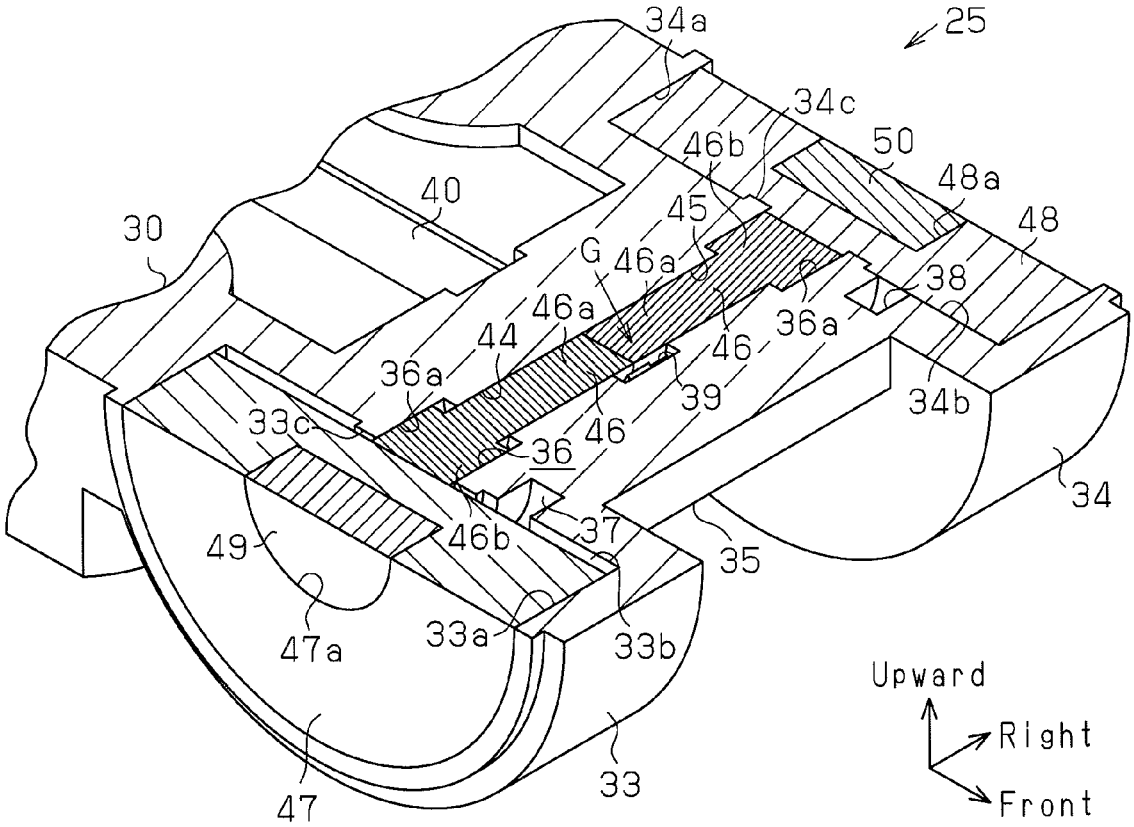
FIG. 7 is a cross-sectional view showing a main portion of the switching device shown in FIG. 3.
Figure 8:
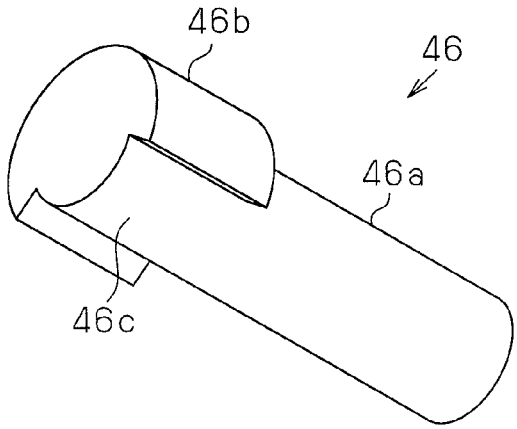
FIG. 8 is a perspective view showing transmission members of the switching device shown in FIG. 3.

As shown in FIG. 7, substantially columnar transmission members 46 are received in the first joint line 44 and the second joint line 45 in such a manner that the transmission members 46 are slidable in the left-and-right direction. With reference to FIG. 8, each of the transmission members 46 has a columnar small diameter portion 46*a* and a large diameter portion 46*b* the diameter of which is greater than the diameter of the small diameter portion 46*a*. A cutout 46*c* is provided in the large diameter portion 46*b* in such a manner as to cover the angular range of 90 degrees. The diameter of the cutout 46*c* is equal to the diameter of the small diameter portion 46*a*.

With reference to FIGS. 3 and 7, one of the two transmission members 46 is passed through the first joint line 44 from the side corresponding to the small diameter portion 46*a* and the other transmission member 46 is passed through the second joint line 45 from the side corresponding to the small diameter portion 46*a*. In this manner, each of the transmission members 46 is accommodated in the corresponding one of the joint lines 44, 45. In this case, the cutout 46*c* of each transmission member 46 faces downward and the large diameter portion 46*b* of the transmission member 46 is received in the corresponding large diameter portion 36*a* of the joint passage 36. The end surfaces of the small diameter portions 46*a* of the transmission members 46 contact each other at the center of the joint passage 36 in the left-and-right direction. The sum of the longitudinal dimensions of the two transmission members 46 is slightly greater than the longitudinal dimension of the joint passage 36 in the left-and-right direction.

A first disk-like flexible ON-OFF valve 47 is loosely arranged in the first valve body receiving portion 33 and a second ON-OFF valve 48 shaped and configured identically with the first ON-OFF valve 47 are loosely received in the second valve body receiving portion 34. A first circular recess 47*a* is defined in the outer central portion of the first ON-OFF valve 47 and a second circular recess 48*a* is provided in the outer central portion of the second ON-OFF valve 48. A first disk-like rigid link member 49 is loosely received in the first recess 47*a* and a second disk-like rigid link member 50 is loosely accommodated in the second recess 48*a*.

The first recess 47*a* and the second recess 48*a* are shaped identically with each other and the first link member 49 and the second link member 50 are shaped identically with each other. A flexible film (not shown) is secured to the left surface of the body 30 in such a manner as to seal the opening of the first valve body receiving portion 33 and the opening of the first communication groove 37. Another flexible film (not shown) is secured to the right surface of the body 30 in such a manner as to seal the opening of the second valve body receiving portion 34 and the opening of the second communication groove 38.

Operation of the switching device 25 will hereafter be explained.

Figure 9:
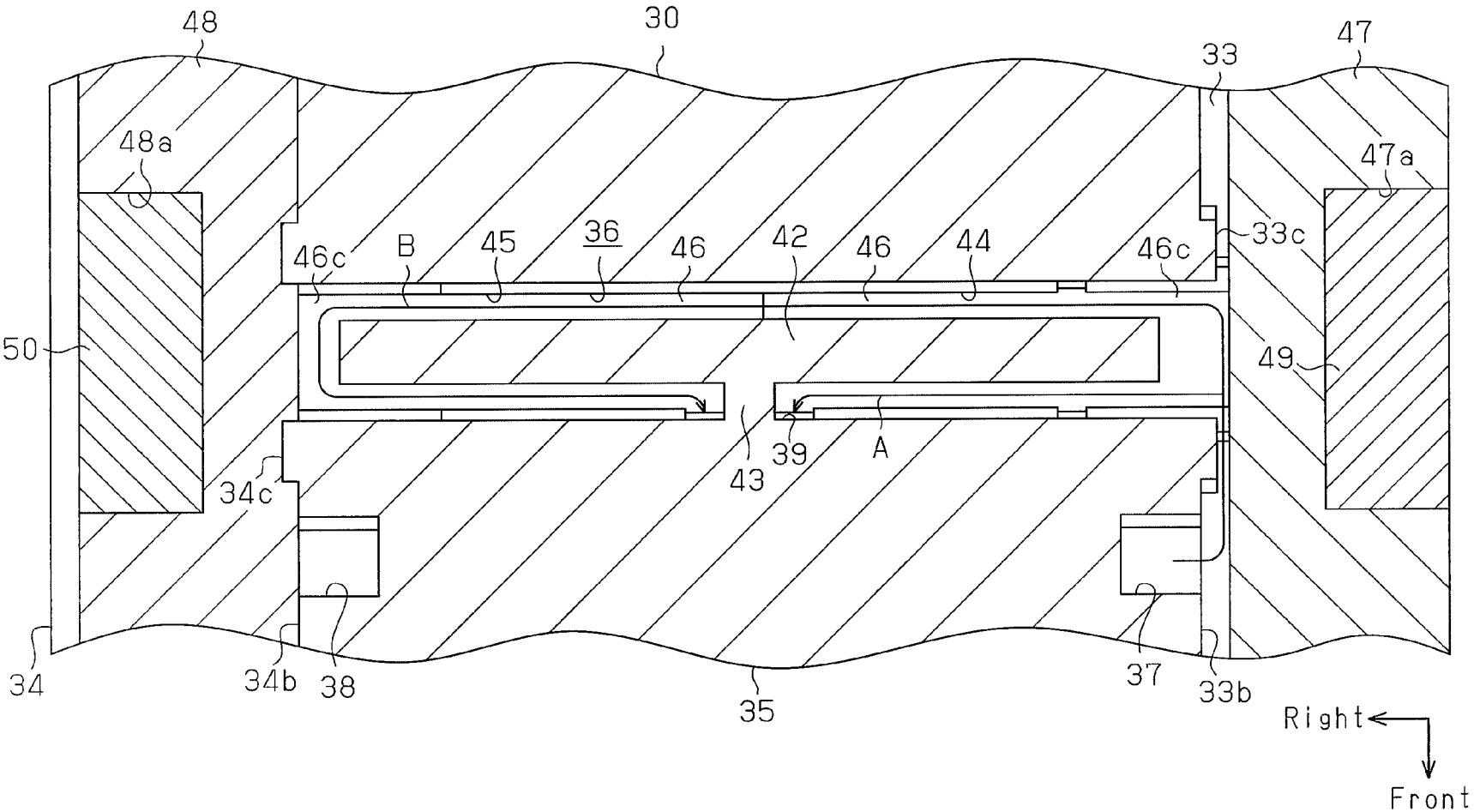
FIG. 9 is a view showing the switching device shown in FIG. 3 in a state in which a first ON-OFF valve is open and a second ON-OFF valve is closed.
Figure 10:
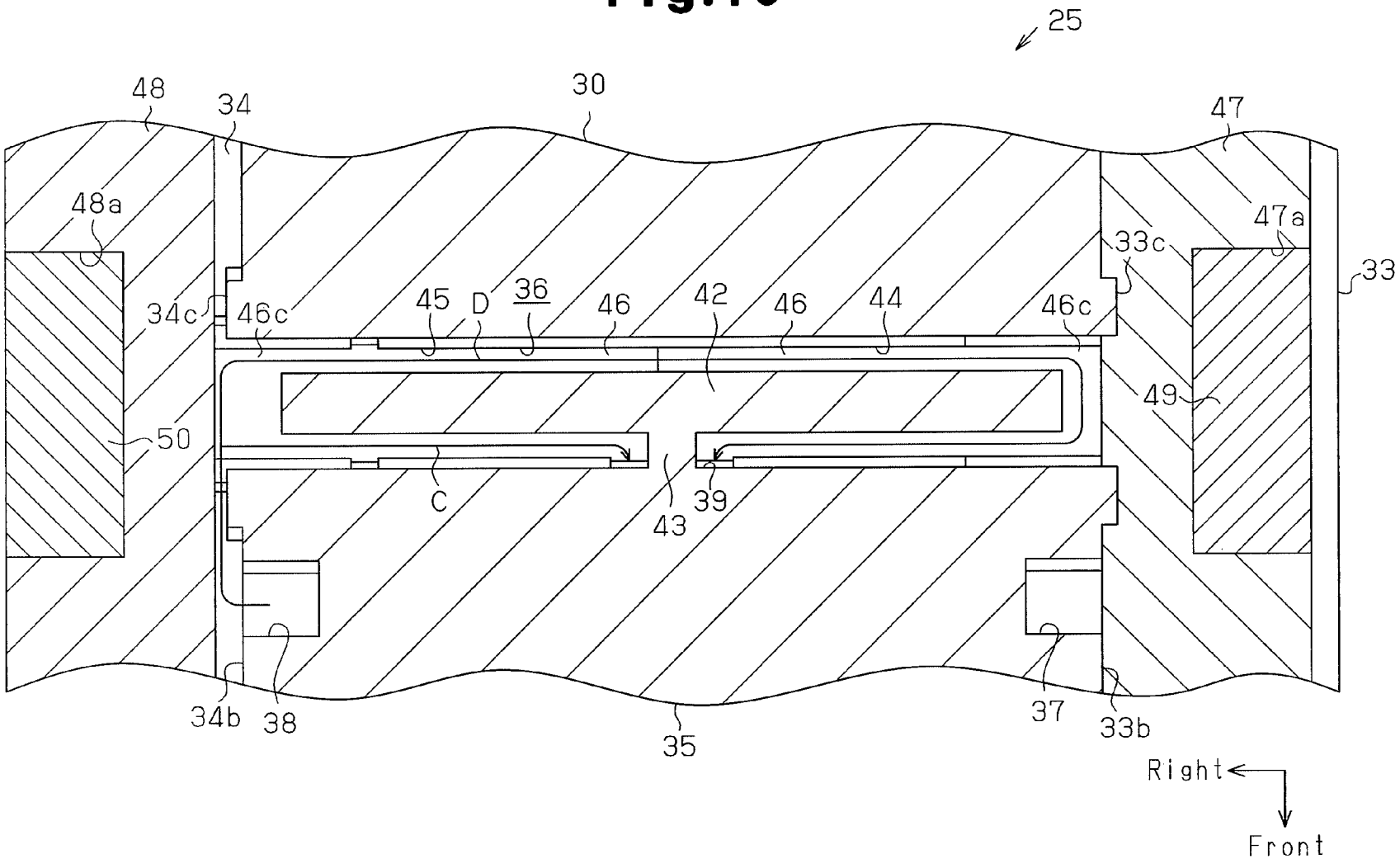
FIG. 10 is a view showing the switching device shown in FIG. 3 in a state in which the first ON-OFF valve is closed and the second ON-OFF valve is open.

FIGS. 9 and 10 are cross-sectional views each showing the body 30 with the joint portion 35 viewed from below.

To switch types of the ink supplied to the recording head 18 from matte black ink to photo black ink, the second ON-OFF valve 48 is first pressed leftward through the second link member 50. This causes close contact between the second ON-OFF valve 48 and the second projection 34*c*, as illustrated in FIG. 9, and the first ON-OFF valve 47 is pressed leftward through the two transmission members 46. The first ON-OFF valve 47 is thus separated from the first projection 33*c*. In this state, the first communication groove 37 and the first joint line 44 communicate with each other through the first receiving portion 33 and the second communication groove 38 and the second joint line 45 are disconnected from each other. In other words, the first ON-OFF valve 47 is maintained open and the second ON-OFF valve 48 is held closed.

Subsequently, flushing is performed so that the matte black ink, which is the ink that has been previously used, is drained from the nozzle row 20*a* of the recording head 18 into the cap 27. This causes the photo black ink to flow from the first communication groove 37 into the first joint line 44 through the first receiving portion 33. In such flushing, the ink is discharged exclusively from the nozzle row 20*a*.

After having flowed into the first joint line 44, the photo black ink is divided into a first ink flow A indicated by arrow A in FIG. 9 and a second ink flow B indicated by arrow B in the drawing. The first ink flow A proceeds in the space forward from the ink guide portion 42 in the first joint line 44 and reaches the first through hole 39. The second ink flow B passes through the space rearward from the ink guide portion 42 in the first and second joint lines 44, 45, the vicinity of the second ON-OFF valve 48, and the space forward from the ink guide portion 42 in the second joint line 45 and reaches the first through hole 39. These flows of the photo black ink in the second joint line 45 suppress retaining of the photo black ink in the joint passage 36 as a whole. As a result, the matte black ink, the ink that has been previously used, is prevented from being retained in the second joint line 45 after the matte black ink is switched to the photo black ink.

The interference suppressing portion 43 suppresses interference between the first ink flow A and the second ink flow B. The first ink flow A and the second ink flow B are thus allowed to smoothly flow into the first through hole 39 without stopping.

Contrastingly, to switch the types of the ink supplied to the recording head 18 from the photo black ink to the matte black ink, the first ON-OFF valve 47 is pressed rightward through the first link member 49. This causes close contact between the first ON-OFF valve 47 and the first projection 33*c*, as illustrated in FIG. 10, and the second ON-OFF valve 48 is pressed rightward through the two transmission members 46. The second ON-OFF valve 48 is thus separated from the second projection 34*c*. In this state, the second communication groove 38 and the second joint line 45 communicate with each other through the second receiving portion 34, and the first communication groove 37 and the first joint line 44 are disconnected from each other. In other words, the first ON-OFF valve 47 is closed and the second ON-OFF valve 48 is held open.

Subsequently, the photo black ink, the ink that has been previously used, is drained from the nozzle row 20*a* of the recording head 18 into the cap 27 through flushing. This causes the matte black ink to flow from the second communication groove 38 into the second joint line 45 through the second receiving portion 34. In flushing, the ink is discharged exclusively from the nozzle row 20*a*.

After having flowed into the second joint line 45, the matte black ink is divided into a third ink flow C indicated by arrow C in FIG. 10 and a fourth ink flow D indicated by arrow D in the drawing. The third ink flow C proceeds in the space forward from the ink guide portion 42 in the second joint line 45 and reaches the first through hole 39. The fourth ink flow D passes through the space rearward from the ink guide portion 42 in the first and second joint lines 44, 45, the vicinity of the first ON-OFF valve 47, and a front space in the first joint line 44, and reaches the first through hole 39. These flows of the matte black ink in the first joint line 44 suppress retaining of the matte black ink in the joint passage 36 as a whole. As a result, the photo black ink, the ink that has been previously used, is prevented from being retained in the first joint line 44 after the photo black ink is switched to the matte black ink.

The interference suppressing portion 43 suppresses interference between the third ink flow C and the fourth ink flow D. The third ink flow C and the fourth ink flow D are thus allowed to smoothly flow into the first through hole 39 without stopping.

As has been described, in switching between the photo black ink and the matte black ink, the previously used ink is prevented from being retained in the joint passage 36 of the switching device 25. The photo black ink and the matte black ink are thus prevented from being mixed together. This suppresses lowering of printing quality after switching of ink types.

The illustrated embodiment has the following advantages.

When the first ON-OFF valve 47 is open and the second ON-OFF valve 48 is closed, the ink guide portion 42 causes some of the photo black ink to flow into the first through hole 39 via the second joint line 45. When the second ON-OFF valve 48 is open and the first ON-OFF valve 47 is closed, the ink guide portion 42 causes some of the matte black ink to flow into the first through hole 39 via the first joint line 44. This suppresses retaining of the photo black ink or the matte black ink in the joint passage 36. In other words, in switching between the photo black ink and the matte black ink, the previously used ink is prevented from being retained in the joint passage 36 after the ink is switched to the other type.

This suppresses mixing of the currently used ink, which is the photo black ink or the matte black ink, with the other ink. As a result, printing quality is maintained regardless of switching of the ink types.

The width of the ink guide portion 42 becomes smaller toward the top. This decreases the volume of the space occupied by the ink guide portion 42 in the joint passage 36, increasing the volume of the joint passage 36 in the switching device 25.

The ink guide portion 42 has the interference suppressing portion 43 projecting into the first through hole 39. This suppresses interference between the first ink flow A and the second ink flow B when the photo black ink flows in the joint passage 36 after the matte black ink has been switched to the photo black ink. The first ink flow A and the second ink flow B are thus allowed to smoothly flow into the first through hole 39. Likewise, the interference suppressing portion 43 suppresses interference between the third ink flow C and the fourth ink flow D when the matte black ink flows in the joint passage 36 after the photo black ink has been switched to the matte black ink. The third ink flow C and the fourth ink flow D are thus allowed to smoothly flow into the first through hole 39.

The ink guide portion 42 is configured by the two portions that are laterally symmetrical with respect to the interference suppressing portion 43, which is located at the longitudinal center of the ink guide portion 42. Thus, interference between the first ink flow A and the second ink flow B and interference between the third ink flow C and the fourth ink flow D are suppressed to the equal extents.

Switching between the matte black ink and the photo black ink is brought about through flushing in which the ink is discharged solely from the nozzle row 20*a*. Thus, in switching of the inks, types of ink other than the matte black ink and the photo black ink are prevented from being consumed. If the cap 27 is an integral type that covers the nozzle rows 20*a* to 20*c* as a whole and switching between the matte black ink and the photo black ink is carried out through cleaning, the types of ink other than the matte and photo black inks are wastefully consumed.

The illustrated embodiment may be modified in the following forms.

The interference suppressing portion 43 does not necessarily have to be arranged at the longitudinal center of the ink guide portion 42. Specifically, the interference suppressing portion 43 may be provided at a position rightward or leftward from the longitudinal center of the ink guide portion 42.

The interference suppressing portion 43 may be formed in a thin plate-like shape.

The interference suppressing portion 43 does not necessarily have to extend toward the first through hole 39.

The interference suppressing portion 43 may be omitted.

The interference suppressing portion 43 may be formed separately from the ink guide portion 42.

The width of the ink guide portion 42 does not necessarily have to become smaller toward the top.

The ink guide portion 42 may be formed either integrally with or independently from the lower wall of the joint passage 36.

In the illustrated embodiment, the switching device 25 switches between the matte black ink and the photo black ink. However, such switching may be carried out between a dark tone and a light tone of the same color of ink such as cyan ink and light cyan ink or magenta ink and light magenta ink.

The switching device 25 may be configured in such a manner that the first joint line 44 and the second joint line 45 are connected together to form a V shape or a U shape. In other words, the switching device 25 may be provided in such a manner that the joint passage 36 is V-shaped or U-shaped. In this case, the shape of each transmission member 46 must be changed in correspondence with the shape of the joint passage 36.

The liquid ejection apparatus is not restricted to the inkjet type printer but may be a type that ejects a different type of liquid. That is, the liquid ejection apparatus may be, for example, a liquid ejection apparatus that ejects liquid such as electrode material or color material used in the manufacture of liquid crystal displays, EL displays, and surface light emitting displays, or a liquid ejection apparatus that ejects bioorganic matter used in the manufacture of biochips or a sample ejection apparatus such as a precision pipette.

What is claimed is:

1. A liquid ejection apparatus comprising:

a liquid ejection head that ejects a liquid; and a switching device that selectively switches types of the liquid supplied to the liquid ejection head between a first liquid and a second liquid different from the first liquid, the switching device including:

a first supply passage through which the first liquid flows;

a second supply passage through which the second liquid flows;

a head supply passage extending from a joining point between a downstream end of the first supply passage and a downstream end of the second supply passage to the liquid ejection head;

a first ON-OFF valve that selectively opens and closes the first supply passage at a position upstream from the joining point;

a second ON-OFF valve that selectively opens and closes the second supply passage at a position upstream from the joining point; and a liquid guide portion formed in the first and second supply passages at a position between the first ON-OFF valve and the second ON-OFF valve, wherein, when the first ON-OFF valve is open and the second ON-OFF valve is closed, the liquid guide portion divides the first liquid into a first liquid flow proceeding from the first supply passage directly to the head supply passage and a second liquid flow flowing from the first supply passage into the head supply passage after passing the vicinity of the second ON-OFF valve in the second supply passage, and wherein, when the first ON-OFF valve is closed and the second ON-OFF valve is open, the liquid guide portion divides the second liquid into a third liquid flow proceeding from the second supply passage directly to the head supply passage and a fourth liquid flow flowing from the second supply passage into the head supply passage after passing the vicinity of the first ON-OFF valve in the first supply passage.

2. The liquid ejection apparatus according to claim 1, wherein the first supply passage and the second supply passage extend along a common imaginary line, wherein the liquid guide portion projects from a wall surface defining the first and second supply passages and extends linearly and continuously along both of the first and second supply passage, and wherein the width of the liquid guide portion in a direction perpendicular to the longitudinal direction of the liquid guide portion becomes smaller toward the top of the liquid guide portion.

3. The liquid ejection apparatus according to claim 1, wherein the liquid guide portion has an interference suppressing portion that suppresses interference between the first liquid flow and the second liquid flow, and interference between the third liquid flow and the fourth liquid flow.

4. The liquid ejection apparatus according to claim 3, wherein the interference suppressing portion is formed at a position corresponding to the head supply passage in such a manner as to extend toward the head supply passage.

5. The liquid ejection apparatus according to claim 3, wherein the liquid guide portion is symmetrical with respect to a plane that extends perpendicular to the longitudinal direction of the liquid guide portion and includes the interference suppressing portion.

6. A liquid ejection apparatus comprising:

a liquid ejection head that ejects a liquid; and a switching device that selectively switches types of the liquid supplied to the liquid ejection head between a first liquid and a second liquid different from the first liquid, the switching device including:

a first supply passage through which the first liquid flows;

a second supply passage through which the second liquid flows, the first supply passage and the second supply passage extending along a common imaginary line and being joined together at the downstream ends of the first and second supply passages;

a head supply passage extending from the joining point between the first supply passage and the second supply passage to the liquid ejection head;

a first ON-OFF valve that selectively opens and closes the first supply passage at a position upstream from the joining point;

a second ON-OFF valve that selectively opens and closes the second supply passage at a position upstream from the joining point; and a liquid guide portion that projects from a wall surface defining the first and second supply passages and extends linearly and continuously along both of the first and second supply passages.

7. The liquid ejection apparatus according to claim 6, wherein the liquid guide portion includes an interference suppressing portion that suppresses interference between the first liquid flow and the second liquid flow, and interference between the third liquid flow and the fourth liquid flow.

8. The liquid ejection apparatus according to claim 7, wherein the interference suppressing portion is formed at a position corresponding to the head supply passage in such a manner as to extend toward the head supply passage.

9. The liquid ejection apparatus according to claim 7, wherein the liquid guide portion is configured by two portions forming mirror images in shape with respect to a plane extending perpendicular to the longitudinal direction of the liquid guide portion and passing the interference suppressing portion.

* * * * *

UNITED STATES PATENT AND TRADEMARK OFFICE

CERTIFICATE OF CORRECTION

PATENT NO. : 7,905,585 B2
APPLICATION NO. : 11/944164
DATED : March 15, 2011
INVENTOR(S) : Ryoichi Tanaka and Toshio Kumagai It is certified that error appears in the above-identified patent and that said Letters Patent is hereby corrected as shown below:

On the Title Page:

Item (73), please correct the assignee from "Seiko Corporation"
to "Seiko Epson Corporation".

Signed and Sealed this
Seventeenth Day of May, 2011

David J. Kappos

David J. Kappos
*Director of the United States Patent and Trademark Office*